US005125532A

United States Patent [19]

Casagrande

[11] Patent Number: 5,125,532

[45] Date of Patent: Jun. 30, 1992

[54] SYSTEM FOR THE PERMANENT STORAGE OF RADIOACTIVE WASTES

[75] Inventor: Bruno Casagrande, Fontanafredda, Italy

[73] Assignee: Casagrande SpA, Fontanafredda, Italy

[21] Appl. No.: 541,383

[22] Filed: Jun. 21, 1990

[30] Foreign Application Priority Data

Jul. 13, 1989 [IT] Italy ..... 83455 A/89

[51] Int. Cl.[5] ..... G21F 5/00

[52] U.S. Cl. ..... 220/468; 250/506.1; 250/507.1

[58] Field of Search ..... 220/444, 468; 206/524.1, 524.3, 524.4, 524.5; 250/506.1, 507.1, 518.1

[56] References Cited

U.S. PATENT DOCUMENTS

| | | | |
|---|---|---|---|
| 4,513,205 | 4/1985 | Splinter | 250/507.1 |
| 4,778,628 | 10/1988 | Saha et al. | 250/506.1 X |
| 4,818,878 | 4/1989 | Popp et al. | 250/506.1 X |
| 4,845,372 | 7/1989 | Mallory et al. | 250/507.1 X |
| 4,996,019 | 2/1991 | Catalayoud | 250/507.1 X |

FOREIGN PATENT DOCUMENTS

| | | |
|---|---|---|
| 8400637 | 2/1984 | European Pat. Off. . |
| 0245912 | 11/1987 | European Pat. Off. . |
| 2132814 | 7/1984 | United Kingdom . |
| 2199180 | 6/1988 | United Kingdom . |

*Primary Examiner*—Steven M. Pollard
*Attorney, Agent, or Firm*—Nixon & Vanderhye

[57] ABSTRACT

System for the permanent storage of radioactive wastes (11) and of wastes in general involving a great risk of environmental and human contamination, the radioactive wastes (11) being collected in drums (12) or other suitable means, the drums (12) being capable of being stacked and gathered within containers (13) consisting advantageously of centrifuged concrete, the system arranging that a multi-barrier configuration is interposed between the radioactive source (11) and the surrounding terrain (17), the multiple barriers consisting of concrete structures (13-15-16) and of clay (14-114-214) injected in the liquid state within the concrete structures (13-15-16) so as to fill the whole of the empty interspaces, the clay solidifying into an impermeable plastic agglomerate after being injected.

7 Claims, 2 Drawing Sheets

SYSTEM FOR THE PERMANENT STORAGE OF RADIOACTIVE WASTES

BACKGROUND OF THE INVENTION

1. Field of the Invention

This invention concerns a system for the permanent storage of radioactive wastes and of wastes in general involving a great risk of environmental and human contamination.

To be more exact, the invention concerns a system providing levels of protection against the radioactive material which are functional according to the degree of danger involved by that material, the protection being ensured in the long term even in the event of natural disasters.

2. Discussion of Prior Art

The system of the invention can be applied to sites and terrains of any nature and disposition.

The state of the art includes a plurality of methods and devices for the disposal of toxic and/or radioactive wastes.

Such wastes and, in particular, the radioactive wastes to which we shall refer in the description hereinafter are collected in specific drums or other suitable means having appropriate shapes and sizes.

A plurality of these drums is stacked in turn in an organized manner within storage containers.

Documents IT 83461 A/86 and IT 83413 A/87 in the name of the same applicant describe containers which consist advantageously of high-density centrifuged concrete and are suitable to hold toxic and radioactive wastes.

IT 83413 A/87 cited above discloses also some solutions for the storage of such containers in sites equipped for the purpose, but these solutions may be suitable for temporary, but not permanent, storage of radioactive material.

The most widespread solution nowadays for the permanent storage of radioactive material of medium and low activity consists in placing the containers within stores formed with buried concrete constructions, which are covered with a plurality of layers of clay or another suitable material compacted by mechanical means.

This compacting cannot ensure complete homogeneity of the clay barriers, and this leads to a non-impermeable, imperfect barrier which is not proof against aggressive substances.

In particular, rain water and water from strata lying higher than the stores may develop preferred routes in the long term and arrive within the stores, in conjunction also with possible natural movements of the ground, of a telluric kind for instance, with a grave danger for the airtight seal of the containers themselves.

EP-A-0245912 discloses an underground barrier structure for wastes. The structure consists of a first container within which the waste is deposited and which consists of walls made of a carbonaceous material. A second series of walls is formed of zeolite, and a third series consists of clay. The structure described in EP '912 is not suitable to ensure an efficient degree of protection, especially for radioactive wastes.

WO-A-8400637 describes a storage structure for wastes of various kinds. The structure provides an inner container for the wastes and an outer protective container; a water barrier separates the two containers. The structure described in WO '637 provides for temporary storage of wastes; in fact, access to the inner container is possible. The structure is therefore not suitable for radioactive wastes, as is shown by the use of water as a protective means.

The present applicant has designed a system for the permanent storage of radioactive wastes which is able to overcome the problems of the state of the art.

SUMMARY OF THE INVENTION

The invention is set forth in the main claim, while the dependent claims describe various characterizations of the invention.

The system of the invention provides for the radioactive material to be protected in a multiple-barrier layout, the barriers consisting preferably of concrete and clay which is injected in the liquid state and then solidifies into an impermeable plastic agglomerate.

The concrete is employed to construct buried chambers, positioned one within another.

The radioactive material, which is held advantageously in the drums and/or chambers as described in IT 83413 A/87, is placed within such chambers according to its degree of activity.

In other words, the radioactive material is classified beforehand and the most dangerous material is located within the innermost chamber of the storage system, and so on until the outermost chamber.

Clay in the liquid state is injected into each chamber and/or the containers themselves so as to fill up any empty spaces.

The injection of clay in the liquid state enables one or more shields or homogeneous barriers of a material of a controlled quality without any gaps to be produced about the radioactive source. These shields do not permit the migration of water or any other material.

In the long term this clay in the liquid state solidifies into a dense stable mass that ensures a perfect degree of impermeability.

This solidified mass remains also in a plastic condition and its deformations thus make possible the absorption of any movement which the system may undergo in the long term without impairing its perfect impermeability.

For this purpose the concrete structures too will possess advantageously properties able to withstand such movements.

The number of protective barriers for one and the same radioactive source will depend on the level of activity of the source itself.

As we said earlier, materials possessing differing levels of activity can be arranged in a coordinated manner in one and the same protective lay-out or in a lay-out comprising a series of barriers determining several chambers positioned one inside another.

In this way a multipurpose system can be made available at a modest cost with perfect efficiency and safety.

BRIEF DESCRIPTION OF THE DRAWINGS

These and other special features of the invention will be made clearer in the following description.

The attached figures, which are given as a non-restrictive example, show the following.

DETAILED DESCRIPTION OF PREFERRED EMBODIMENTS

Figure 1:
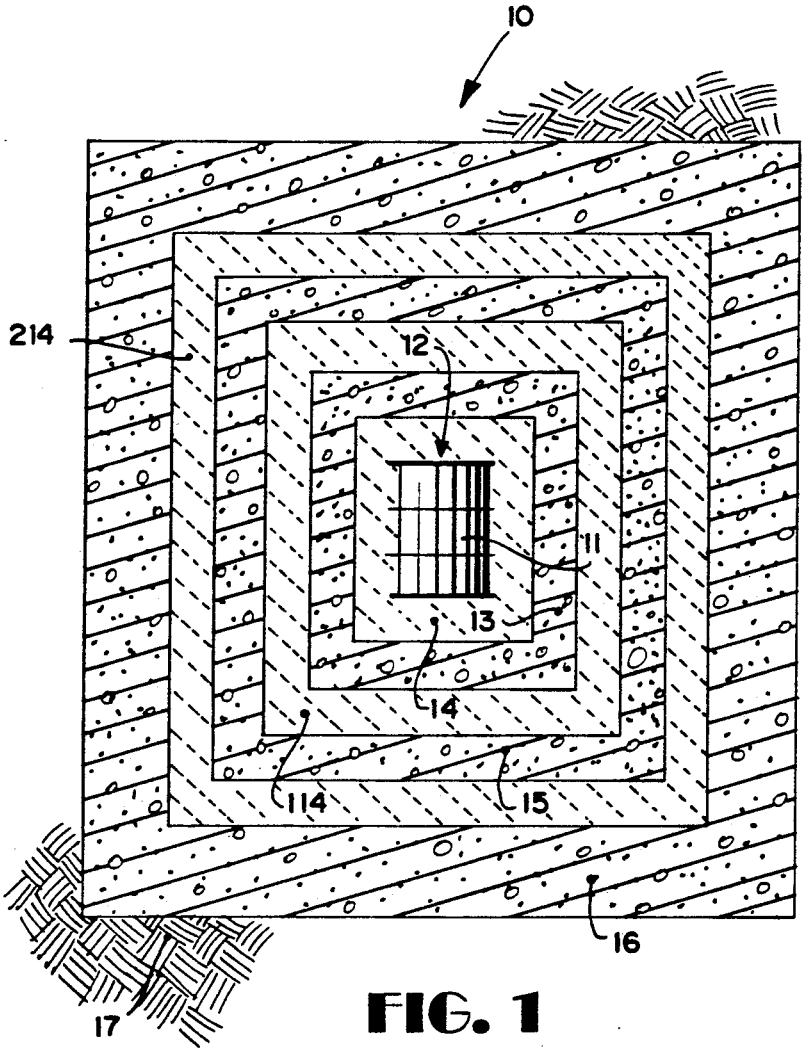
FIG. 1 is a diagram of a possible storage system according to the invention.

In FIG. 1 a storage system 10 of the invention comprises in the diagram shown a plurality of barriers arranged about a radioactive source 11.

This radioactive source 11 is held in drums 12 or other suitable means, which in turn are stacked in containers 13 that are advantageously of the centrifuged concrete type described in the above cited IT 83413 A/87.

A special clay in the liquid state is introduced into the container 13 and, when solidified, forms a first protective barrier 14.

This clay fills all the gaps completely between the drums 12 and the inner surfaces of the container 13.

The clay may be advantageously, but not only, a mixture of various clayey materials in water, such as pure clay, bentonite, zeolite and other materials bonded together with a cement element.

The container 13 itself forms a second protective barrier.

The container 13 in turn is lodged within a secondary chamber 15 having concrete walls; the gap between the chamber 15 and container 13 is filled with clay injected in the liquid state, as cited earlier.

The layer of filling clay forms a third protective barrier 114, whereas the secondary chamber 15 itself is the fourth protective barrier.

The secondary chamber 15 in turn is located within a primary chamber 16, which too is made of concrete and is generally positioned in contact with the ground 17 of the excavation.

Liquid clay forming a fifth protective barrier 214 is injected likewise between the primary chamber 16 and secondary chamber 15.

The primary chamber 16 itself forms the sixth protective barrier, just as the surrounding ground 17 is the natural seventh protective barrier.

Figure 3:
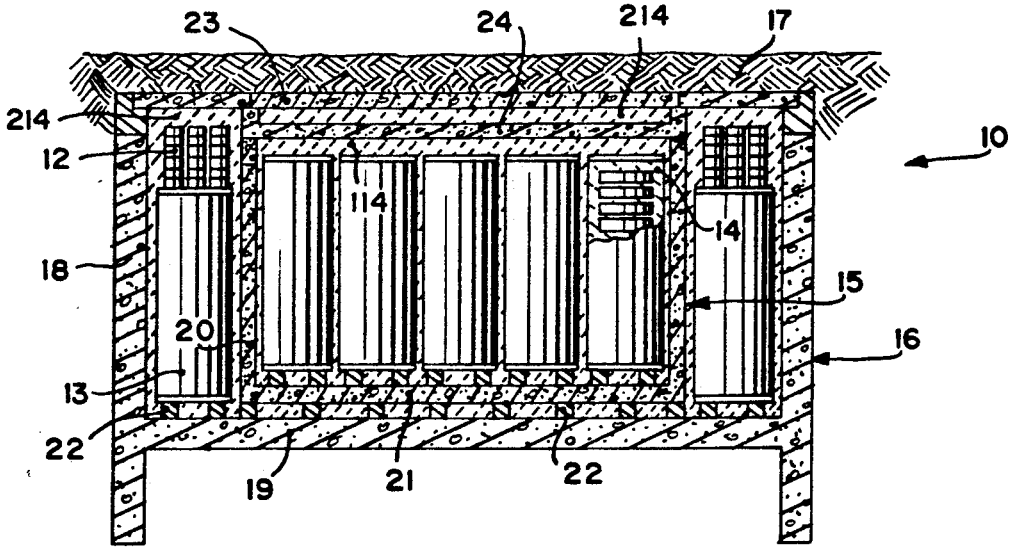
FIG. 3 is a cross section on an enlarged scale of the embodiment of FIG. 2 along the line A—A.
Figure 2:
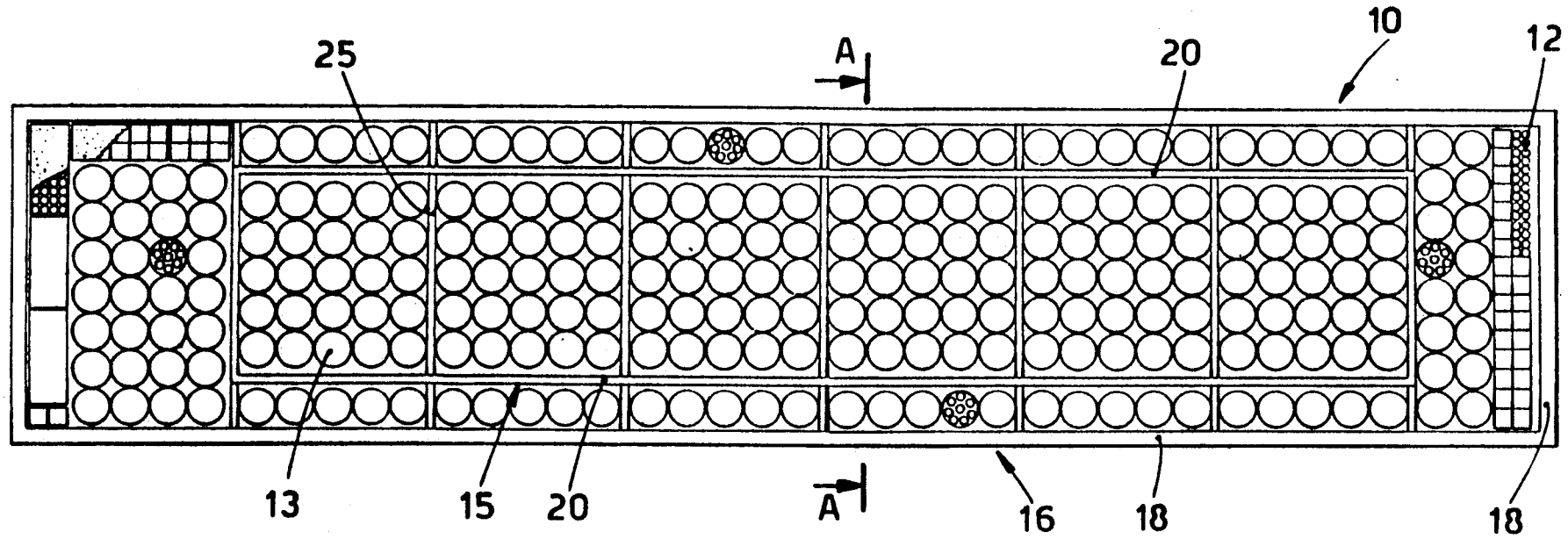
FIG. 2 shows a plan view of an embodiment of the system according to the invention.

FIGS. 2 and 3 show a practical embodiment of the system 10 of FIG. 1. In this case the primary chamber 16 consists of walls 18 and a floor 19, both of which are made of concrete.

The technique of diaphragm walls will be chosen advantageously for the construction of outer walls 18 of the structure, for this technique enables very modest and strong excavations to be made which can be carried out quickly without disturbing the surrounding structures, and at the same time provides flexible walls 18 at low cost which are suitable for safe use even in zones subject to earthquakes.

The secondary chamber 15 too comprises walls 20 and a floor 21, the latter 21 being supported on the floor 19 of the primary chamber 16, in this case by the interposition of plinths 22.

The floor 21 of the secondary chamber 15 is constructed advantageously by using pre-fabricated concrete panels bonded together by means of the walls 20.

Likewise, ceilings 23 and 24 of the primary 16 and secondary 15 chambers respectively can be constructed advantageously by using prefabricated concrete slabs.

The relative joints are made watertight with bitumen to prevent any migration of water.

Moreover, the primary 16 and secondary 15 chambers can be divided into cells of a modular type (see FIG. 2) or otherwise as required, for instance by means of partitions 25. These partitions 25 are made advantageously on the site with cast reinforced concrete and form also a horizontal support for the walls 18 and 20 of the primary 16 and secondary 15 chambers respectively.

The containers 13 holding the drums 12 or boxes or cases or other suitable means may be located within the secondary chamber 15 or between the secondary chamber 15 and primary chamber 16; as we said above, this will depend on the degree of activity of the radioactive material 11 held in the containers 13.

The material 11 having a lower level of activity and held in drums 12 or other suitable means can be merely stacked and rested on the floor 21 of the secondary chamber 15 or above the containers 13, as shown in FIGS. 2 and 3.

The containers 13 are supported on the floors 19 and 21 of the primary 16 and secondary 15 chambers respectively by means of plinths 22.

According to the lay-out of the invention the radioactive material 11 classified at the lowest levels of activity and held in the drums 12 lodged in the primary chamber 16 are provided with a multiple protection consisting, in this case, of three barriers (barrier of clay 214 plus the concrete of the primary chamber 16 plus the ground 17).

The radioactive material 11 classified at medium levels of activity and held in the containers 13 lodged in the primary chamber 16 has a multiple protection consisting, in this case, of five barriers (barrier of solidified clay 14 plus the concrete of the container 13 plus a barrier of solidified clay 214 plus the concrete of the primary chamber 16 plus the ground 17).

The radioactive material 11 classified at the highest levels of activity and held in the containers 13 lodged in the secondary chamber 15 has a multiple protection consisting, in this case, of seven barriers (barrier of solidified clay 14 plus the concrete of the container 13 plus a barrier of solidified clay 114 plus the concrete of the secondary chamber 15 plus a barrier of solidified clay 214 plus the concrete of the primary chamber 16 plus the ground 17).

It is clear that the system 10 of the invention can provide a number of barriers and a lay-out other than that described here, depending on the degree of classification of the radioactive material 11, on the location of the system 10 itself and on many other parameters which may affect the final configuration of the system, this too without departing thereby from the scope of the invention as claimed.

We claim:

1. A container system for the permanent buried storage of hazardous waste materials, wherein said waste is temporarily stored in a non-permanent container, said container system comprising:

at least one layer of impermeable plastic agglomerate surrounding said non-permanent container; and at least one layer of centrifuged concrete surrounding said non-permanent container and said at least one layer of impermeable plastic agglomerate, said impermeable plastic agglomerate comprises solidified liquid clay.

2. The container system according to claim 1 wherein said at least one layer of plastic agglomerate is a first layer of plastic agglomerate and said at least one layer of concrete is a first layer of concrete, said container system further including:

at least a second layer of impermeable plastic agglomerate surrounding said first layer of centrifuged concrete; and at least a second layer of centrifuged concrete surrounding said second layer of impermeable plastic agglomerate.

3. The container system according to claim 2, wherein said first layer of impermeable plastic agglomerate, said first layer of centrifuged concrete and said non-permanent container comprise a movable structure.

4. The container system according to claim 3, wherein said second layer of impermeable plastic agglomerate and said second layer of concrete comprise a buried, non-movable structure.

5. The container system according to claim 1, wherein said first layer of impermeable plastic agglomerate and said first layer of centrifuged concrete comprise a buried, non-movable structure.

6. A method of containing hazardous waste materials stored in a non-permanent container, said method comprising the steps of:

providing at least a first container of centrifuged concrete with an external volume and an internal volume greater than said non-permanent container;

locating said non-permanent container including said hazardous waste in said concrete container with space between said non-permanent container and said concrete container; and filling said space with an impermeable plastic agglomerate comprised of liquid clay; and permitting said liquid clay to solidify forming a first plastic layer.

7. The method of containing hazardous waste materials according to claim 6 further including the additional steps of:

providing a second container of centrifuged concrete having an internal volume and located at a permanent storage site, the internal volume of said second concrete container greater than the external volume of said first container of concrete, said impermeable plastic agglomerate and said non-permanent container;

transporting said first container of centrifuged concrete filled with said impermeable plastic agglomerate and said non-permanent container containing hazardous waste materials to said second container of centrifuged concrete;

locating said first container of concrete, said impermeable plastic agglomerate and said non-permanent container within said second container with space between said first concrete container and said second concrete container; and filling said space between said first and second concrete containers with an impermeable plastic agglomerate comprised of liquid clay; and permitting said liquid clay to solidify forming a second plastic layer.

* * * * *